US008444404B2

(12) United States Patent
Larsen et al.

(10) Patent No.: US 8,444,404 B2
(45) Date of Patent: May 21, 2013

(54) HYDRAULIC MACHINE

(75) Inventors: Henning Lund Larsen, Sydals (DK); Peter Randlev Larsen, Nordborg (DK)

(73) Assignee: Sauer-Danfoss Aps, Nordborg (DK)

( * ) Notice: Subject to any disclaimer, the term of this patent is extended or adjusted under 35 U.S.C. 154(b) by 833 days.

(21) Appl. No.: 12/632,984

(22) Filed: Dec. 8, 2009

(65) Prior Publication Data

US 2010/0150761 A1 Jun. 17, 2010

(30) Foreign Application Priority Data

Dec. 17, 2008 (DE) ..... 10 2008 063 500

(51) Int. Cl.
*F01C 1/02* (2006.01)

(52) U.S. Cl.
USPC ..... 418/61.3; 418/104

(58) Field of Classification Search
USPC ..... 418/61.3, 104
See application file for complete search history.

(56) References Cited

U.S. PATENT DOCUMENTS

| | | | | |
|---|---|---|---|---|
| 3,431,863 | A | 3/1969 | Waldorff | |
| 3,490,383 | A | 1/1970 | Parrett | |
| 3,512,905 | A | 5/1970 | Waldorff | |
| 3,749,195 | A | 7/1973 | Vegners | |
| 3,880,554 | A * | 4/1975 | Termansen et al. | 418/61.3 |
| 3,964,842 | A * | 6/1976 | White, Jr. | 418/15 |
| 4,451,217 | A | 5/1984 | White | |
| 4,657,494 | A | 4/1987 | Erasov | |
| 4,813,856 | A * | 3/1989 | Dlugokecki | 418/61.3 |
| 4,917,585 | A * | 4/1990 | Niemiec et al. | 418/61.3 |
| 5,080,567 | A | 1/1992 | White, Jr. | |
| 5,407,336 | A | 4/1995 | White | |
| 6,071,102 | A | 6/2000 | Hjelsand | |
| 6,293,490 | B1 | 9/2001 | Villinger | |
| 6,699,024 | B2 | 3/2004 | Dong | |
| 2005/0180873 | A1 * | 8/2005 | Hansen et al. | 418/61.3 |

FOREIGN PATENT DOCUMENTS

| | | | |
|---|---|---|---|
| DE | 3526319 | A1 | 2/1987 |
| DE | 195 20 402 | A1 | 12/1996 |
| DE | 195 20 405 | A1 | 12/1996 |
| WO | 96/41950 | A1 | 12/1996 |
| WO | 96/41951 | A1 | 12/1996 |

* cited by examiner

*Primary Examiner* — Hoang Nguyen
(74) *Attorney, Agent, or Firm* — McCormick, Paulding & Huber LLP

(57) ABSTRACT

The invention relates to a hydraulic machine comprising a housing section with a housing, a commutation section and a gear wheel section, the gear wheel section comprising a gear wheel set with an internally toothed gear ring and an externally toothed gear wheel, which engage each other and form working chambers that are connected to at least one inlet connection and at least one outlet connection via the commutation section that comprises a rotary slide valve and a valve plate. It is endeavored to provide such a hydraulic machine that requires only little space. For this purpose, a sealing is arranged between the rotary slide valve and the housing.

8 Claims, 3 Drawing Sheets

HYDRAULIC MACHINE

CROSS REFERENCE TO RELATED APPLICATION

Applicant hereby claims foreign priority benefits under U.S.C. §119 from German Patent Application No. 10 2008 063 500.6 filed on Dec. 17, 2008, the contents of which are incorporated by reference herein.

FIELD OF THE INVENTION

The invention relates to a hydraulic machine comprising a housing section with a housing, a commutation section and a gear wheel section, the gear wheel section comprising a gear wheel set with an internally toothed gear ring and an externally toothed gear wheel, which engage each other and form working chambers that are connected to at least one inlet connection and at least one outlet connection via the commutation section that comprises a rotary slide valve and a valve plate.

BACKGROUND OF THE INVENTION

Such a hydraulic machine is, for example, known from DE 195 20 405 C2 and DE 195 20 402 C2. In such machines, the gear wheel orbits inside the gear ring. For this purpose, a tooth number difference exists between the gear wheel and the gear ring, said difference often being 1. The movement of the gear wheel is transferred to a drive shaft via an articulated shaft.

If the hydraulic machine is operated as a hydraulic motor, a working medium with a working pressure, for example a hydraulic fluid, is supplied at the inlet connection, whereas the outlet connection is usually connected to a tank or at least to a low pressure level. Via the commutation section that comprises a rotary slide valve and a valve plate the hydraulic fluid is guided into selected working chambers of the gear wheel in such a way that an orbiting movement is generated. Depending on the position of the gear wheel, the rotary slide valve and the valve plate always only pressurize the actually required working chambers, while the remaining working chambers are connected to the outlet connection via the rotary slide valve and the valve plate.

When using the hydraulic machine as pump, the drive shaft is driven from the outside. This causes that the gear wheel orbits inside the gear ring and expands and contracts the working chambers one after the other. Thus, a working medium is sucked in through the inlet connection and discharged through the outlet connection. The allocation of the individual working chambers to the inlet connection or the outlet connection that depends on the position of the gear wheel is predetermined by the valve plate and the rotary slide valve.

In order to keep leakages between the rotary slide valve and the valve plate small, it is known, for example from DE 195 20 405 C2, to press the rotary slide valve against the valve plate by means of a pressure plate. The pressure plate is acted upon by the pressure of the incoming working medium. Additionally, a spring is provided that presses the rotary slide valve against the valve plate, so that a sufficient tightness is also ensured when the inlet pressure is low. In order that the pressure plate can also supply a sufficient pressure against the rotary slide valve during a reversal of the rotation direction of the machine, during which also the pressures at the inlet connection and the outlet connection are reversed, a relatively complicated design of the pressure plate is required. This causes on the one side that a relatively large space is required, and on the other side the manufacturing of the machine is also rather cost intensive.

SUMMARY OF THE INVENTION

The invention is based on the task of providing a hydraulic machine that only requires little space.

With a hydraulic machine as mentioned in the introduction, this task is solved in that a sealing is arranged between the rotary slide valve and the housing.

This sealing, for example in the form of an annular sealing, replaces the pressure plate used until now in the state of the art. This is a heavy simplification of the design of the hydraulic machine. At the same time, a machine with a relatively small axial length is achieved. In this connection the term housing concerns both the housing itself and all elements fixed in the housing, for example bearings of a driving position. Thus, the sealing can also be arranged between the rotary slide valve and bearing parts fixed in the housing.

It is particularly preferred that the sealing is axially prestressed. As opposed to the known solutions, the sealing is arranged to be axially unmovable. The elastic properties of the sealing are used to press the rotary slide valve axially against the valve plate, also when no or only a low working pressure is applied. An additional spring is then no longer required. Additionally, a sufficient tightness between the housing and the rotary slide valve is ensured.

Preferably, the sealing is arranged in an annular groove, the position of the sealing in the radial direction being clearance-subjected. This clearance-subjected position is achieved in that the groove has a large width than the sealing. The groove can be made either in the housing or in the rotary slide valve. In order to ensure an axial prestress of the sealing, the depth of the groove should be smaller than the thickness of the sealing. The groove ensures a safe positioning of the sealing. The clearance-subjected position causes that the sealing can be acted upon by the pressure of the working medium. This pressure causes a radial deformation of the sealing and thus an increased pressure against the rotary slide valve, which is then pressed more firmly against the valve plate. When the working pressure is increasing, the rotary slide valve will be pressed against the valve plate with an increasing force, so that a tight connection between the rotary slide valve and the valve plate remains ensured.

Advantageously, the sealing has two areas, the housing-side area being made to be elastic and the area facing the valve plate comprising a friction-reducing material. Thus, the areas lie next to one another in the axial direction. The housing-side area can, for example, be made of a rubber material. The other area may, for example, comprise Teflon, PTFE or the like, to keep the wear and the friction between the sealing and the rotary slide valve small. The required tightness is ensured by the housing-side area. Further, this area can be deformed by the pressurised hydraulic fluid and transfer this deformation in the form of an increased pressure force to the rotary slide valve. At the same time, it provides a static prestressing, which is particularly favourable when starting the machine. The sealing can be made in one piece. However, it is also possible to make it of several pieces, for example of two pieces, one part being the first area and one part being the second area.

Preferably, the sealing is unrotatably held in the housing. Thus, in relation to the housing the sealing performs no relative movement. The sealing can therefore be held relatively firmly in the housing. It is sufficient that only the surface of the sealing, which is in contact with the rotary slide valve, is provided with a low-frictional and wear resistant material. Thus, it is possible to make a relatively large area of the sealing elastic, which is advantageous for the desired function and tightness.

Preferably, the rotary slide valve is unrotatably held on a drive shaft. The drive shaft serves the purpose of transferring the generated rotary movement when the machine is used as a motor. When using the machine as a pump, the drive shaft serves the purpose of providing a required torque. The unrotatable fixing of the rotary slide valve on the drive shaft ensures that the correct working chambers are always connected to the inlet connection or the outlet connection, respectively.

Preferably, in the groove the sealing separates an area that is connected to the inlet connection from an area that is connected to the outlet connection. Depending on the rotation direction of the machine either one side or the other of the sealing will be acted upon by the increased pressure of the working medium. The working medium with low pressure is on the other side. Thus, depending on the rotation direction, the sealing is acted upon by pressure either radially inwards or radially outwards, the clearance-subjected position of the sealing in the groove ensuring that a relatively large surface of the sealing can be acted upon by pressure. This causes that a relatively large deformation of the sealing or a relatively large force transfer via the sealing to the rotary slide valve is possible, so that the rotary slide valve is reliably pressed against the valve plate. The radial deformation and the displacement of the sealing also increase the surface of the rotary slide valve that can be acted upon by the pressure of the working medium. This presses the rotary slide valve against the valve plate with an increased force.

Preferably, the drive shaft has a channel, a working medium being transportable to the rotary slide valve through the channel. The space required in the housing for the supply and discharge of the hydraulic fluid is reduced in that this channel is arranged in the drive shaft. The space required for the hydraulic machine can be further reduced.

It is particularly preferred that the channel connects an outer annular chamber that is formed between the housing and the drive shaft to an inner annular chamber that is formed between the drive shaft and an articulated shaft. As the articulated shaft performs an orbiting movement, an annular chamber is provided between the articulated shaft and the drive shaft. The outer annular chamber between the housing and the drive shaft thus permits a manufacturing with relatively large tolerances, as an outer diameter of the drive shaft does not have to be exactly adapted to an inner diameter of the housing. This makes the design of the hydraulic machine very cost effective.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENTS

Figure 2:
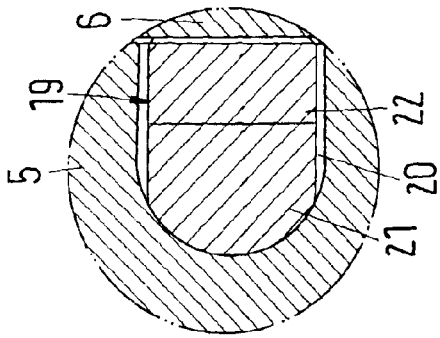
FIG. 2 an enlarged section of FIG. 1.
Figure 1:
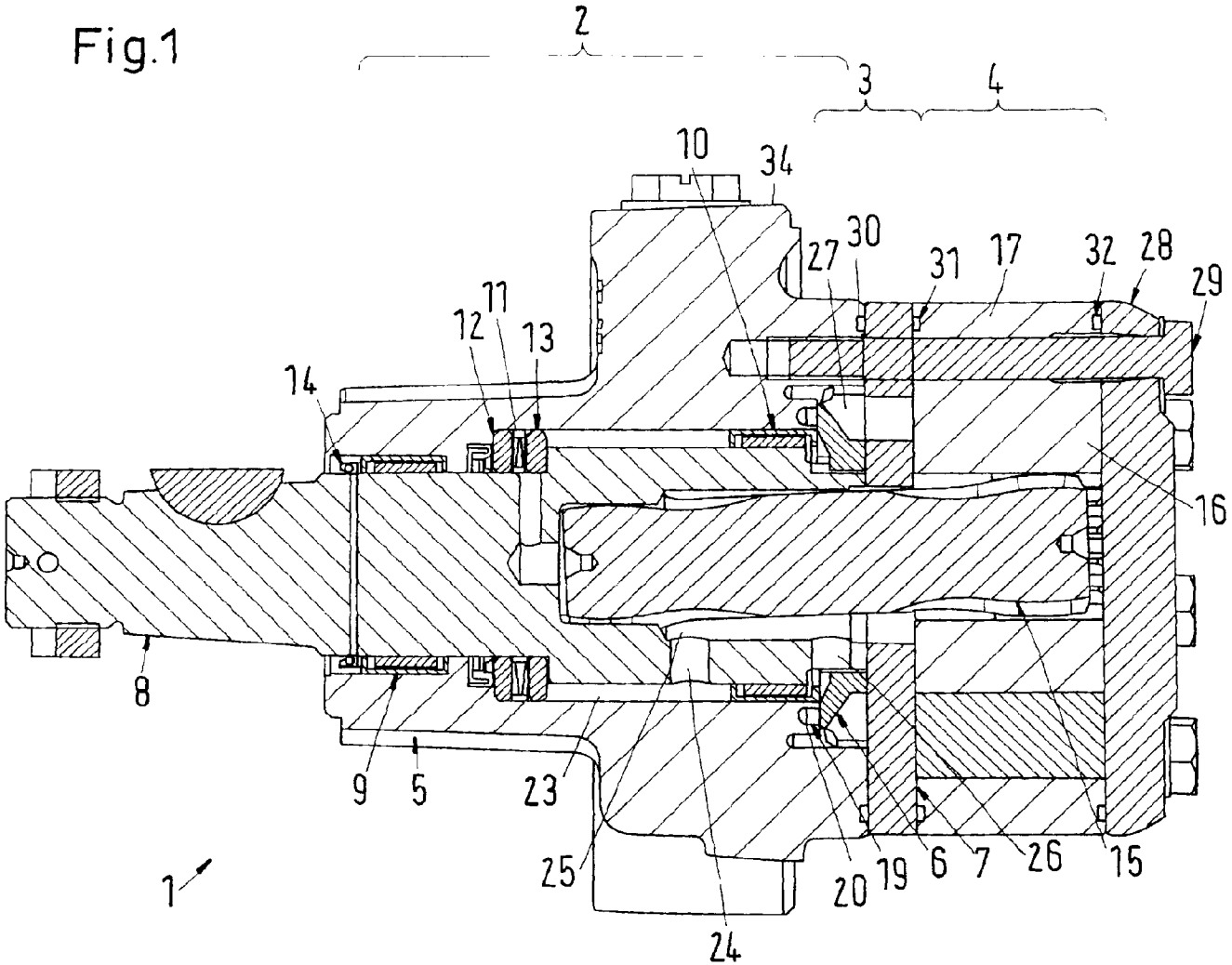
FIG. 1 a schematic cross-section through a hydraulic machine.

FIG. 1 shows a schematic view of a hydraulic machine 1 that comprises a housing section 2, a commutation section 3 and a gear wheel section 4. A housing 5 is arranged in the housing section 2. The commutation section 3 comprises a rotary slide valve 6 and a valve plate 7. The rotary slide valve 6 is located inside the housing 5, so that the housing section 2 and the commutation section 3 overlap each other. The rotary slide valve 6 is unrotatably held on a drive shaft 8 that is supported in the housing by means of two axial bearings 9, 10. Via an axial bearing 11 that comprises a first rotating disc 12 and a second rotating disc 13 an axial movement of the drive shaft 8 in relation to the housing 5 is prevented. For the sealing towards the environment, a sealing 14 is arranged between the housing 5 and the drive shaft 8.

Via an articulated shaft 15, the drive shaft 8 is connected to a gear wheel 16 that is supported to be orbiting in a gear ring 17. For this purpose, the gear wheel 16 has one tooth less than the gear ring 17. The function of a machine with an internally toothed gear ring and an externally toothed gear wheel is, for example, described in detail in DE 195 20 405 C2, and is supposed to be known. Such a machine is also called a gerotor.

During motor operation of the machine, a corresponding pressurising of working chambers that are formed between the gear ring and the gear wheel generates an orbiting movement of the gear wheel in the gear ring. For a rotary movement, a corresponding commutation is required that occurs by means of the rotary slide valve 6 and the valve plate 7. For this purpose, the rotary slide valve 6 and the valve plate 7 have corresponding through openings.

The rotary slide valve 6 is located between the housing 5 and the valve plate 7 and unrotatably connected to the drive shaft 8. Thus, the rotary slide valve 6 rotates in relation to the housing 5, whereas the valve plate 7 is stationary in relation to the housing 5.

Between the housing 5 and the rotary slide valve 6 an axially prestressed sealing 19 is arranged that has the form of an annular sealing and assumes several tasks. Firstly, it presses the rotary slide valve 6 against the valve plate 7 and thus ensures a sufficient tightness between these two elements. Secondly, it separates an area that is connected to an inlet connection, not shown in FIG. 1, from an area that is connected to an outlet connection, not shown in FIG. 1 either. The annular sealing 19 can be located directly between the housing 5 and the rotary slide valve 6, as shown in the embodiments according to FIGS. 1 to 4. However, it is also possible to arrange the annular sealing between the rotary slide valve 6 and a housing-fixed part, for example the housing-fixed part of the radial bearing 10, as shown in the embodiment according to FIG. 5.

The annular sealing 19 is held in an annular groove 20 of the housing 5. As can be seen particularly from FIG. 2, the radial position of the sealing 19 in the groove is clearance-subjected. This means that the groove 20 is made to be wider than the annular sealing 19. Thus, it is possible for the annular sealing 19 to be acted upon by the highly pressurised hydraulic fluid on a relatively large surface, namely its outside or inside. This pressure causes that the sealing 19 is radially compressed, thus acting with an increased pressure in the axial direction upon the rotary slide valve 6, which again is pressed with a larger force against the valve plate 7. Thus, with increasing pressure also the pressure increases that presses the rotary slide valve against the valve plate 7. Therefore, a sufficient tightness is always ensured between the rotary slide valve 6 and the valve plate 7.

Due to the clearance-subjected position, the annular sealing 19 can also be displaced inside the groove 20. This increases the surface of the rotary slide valve 6 that is acted upon with pressure by the working medium. Thus, the rotary slide valve 6 is pressed against the valve plate 7 with an increased force.

The annular sealing 19 comprises a housing-side area 21 and an area 22 facing the valve plate 6, the housing-side area 21 being made of a rubber-elastic material and the other area 22 being made of Teflon or PTFE. Thus, the two areas have different properties. The rubber-elastic area 21 is located at the bottom of the groove. This means that a relatively low-friction and low-wear area of the annular sealing 19 rests on the rotary slide valve 6. A long life of the hydraulic machine is thus ensured. At the same time, the rubber-elastic area 21 also ensures a sufficient tightness of the annular sealing 19. In this embodiment, the annular sealing 19 is made in one piece having the two areas 21, 22. However, it is also possible to make the annular sealing in two parts, each part forming one of the areas 21, 22.

Between the housing 5 and the drive shaft 8 is provided an outer annular chamber 23 that is connected to an inner annular chamber 25 via a channel 24 that is arranged radially in the drive shaft 8. A working medium, in this example a hydraulic fluid, can thus reach the inner annular chamber 25 through the outer annular chamber 23 and the channel 24, and from there it is led into the corresponding working chambers between the gear wheel 16 and the gear ring 17 by means of the rotary slide valve 6 and the valve plate 7. Thus, by means of a further channel 26, it is ensured that the fluid acts upon the annular sealing 19 with a pressure from the radial inside.

The working medium flowing back from the gear wheel section 4 reaches an additional annular chamber 27 that is formed in the housing 5 and bordered by the housing 5, the rotary slide valve 6 and the valve plate 7. The annular chamber 27 is connected to the outside of the annular sealing 19, so that the annular sealing is acted upon from the radial outside by the pressure of the outflowing fluid. Also during a rotation in the rotation direction of the hydraulic machine it is thus ensured that the annular sealing 19 is acted upon radially with a pressure, thus generation an axial force upon the rotary slide valve 6 and pressing it against the valve plate 7.

The gear wheel section 4 is closed by a cover 28 that is held in the housing 5 by means of annularly arranged screws 29. At the same time, the screws 29 hold the gear ring 17 and the valve plate 7. Between the housing 5, the valve plate 7, the gear ring 17 and the cover 28 a relative movement does thus not occur, so the between these elements simple sealing rings 30, 31, 32 are sufficient.

Figure 3:
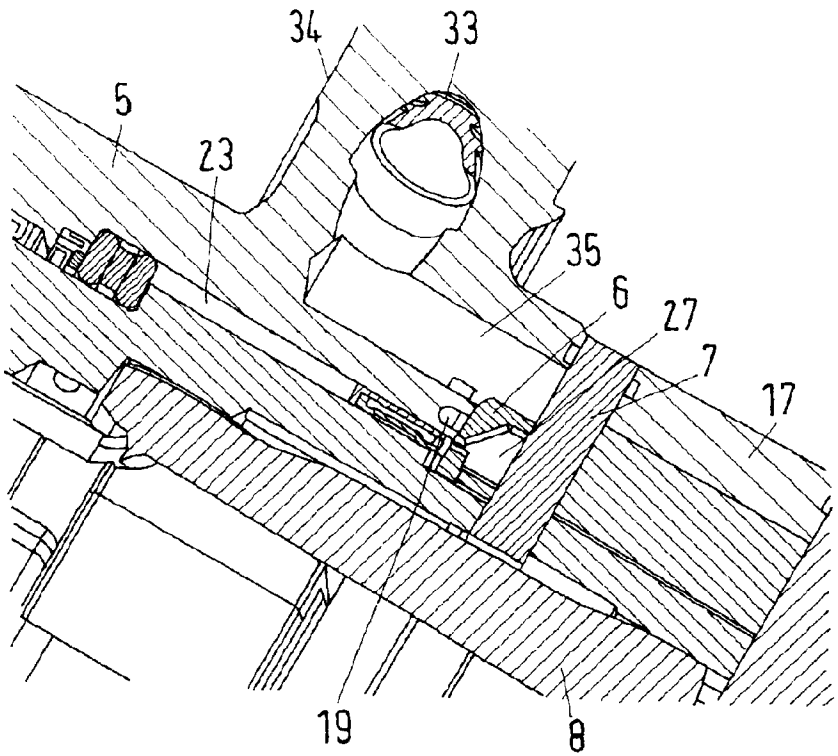
FIG. 3 a schematic cross-section through the hydraulic machine in the area of the inlet connection, FIG. 4 a schematic cross section through the hydraulic machine in the area of the outlet connection, and FIG. 5 a schematic cross-section through a further embodiment.

FIG. 3 shows a section of the hydraulic machine 1 with a connection 33 for a hydraulic fluid. Depending on the rotation direction of the hydraulic machine, the connection 33 can be used as inlet or outlet connection. The connection 33 is arranged in a flange 34 of the housing 5 and is connected to the annular chamber 27 via an axial bore 35.

Figure 4:
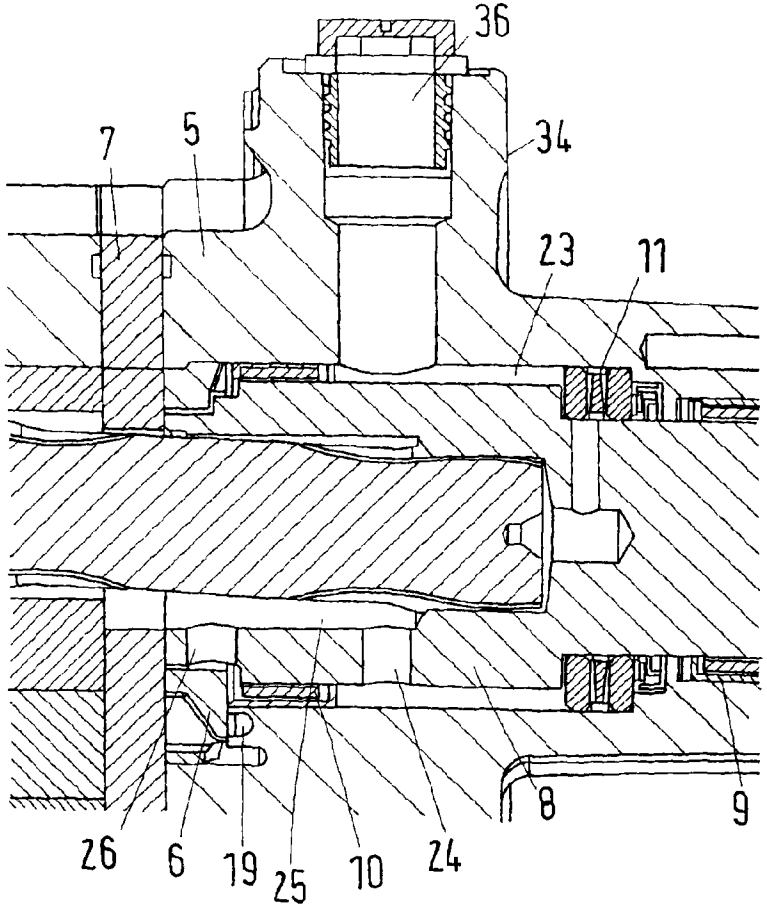

FIG. 4 shows a section of the hydraulic machine 1 with a further connection 36. The connection 36 can also be used as inlet or outlet connection. The connection 36 is arranged radially adjacent to the connection 33 in the flange 34 of the housing 5. The connection 36 is connected to the outer annular chamber 23 that is formed between the housing 5 and the drive shaft 8.

From the connection 36, a hydraulic fluid flows through the outer annular chamber 23, the channel 24 and the inner annular chamber 25 to the rotary slide valve 6 and the valve plate 7, which ensure a corresponding inlet to the gear wheel section 4. In this connection, the inner annular chamber 25 is connected to the annular groove 20 via the channel 26.

The annular sealing 19 thus separates the area of the connection 33 from the area that is connected to the area of the connection 36, which is in this case made as an outlet connection. Thus, both in the inlet area and in the outlet area the annular sealing 19 is acted upon with pressure in the radial direction by the hydraulic fluid. Independently of the rotation direction of the motor the annular sealing 19 is acted upon radially, so that the annular sealing 19 exerts an axial force on the rotary slide valve 6. An additional pressure plate is not required to ensure the tightness between the rotary slide valve 6 and the valve plate 7. Accordingly, the hydraulic machine can be made in a simple and compact manner.

Figure 5:
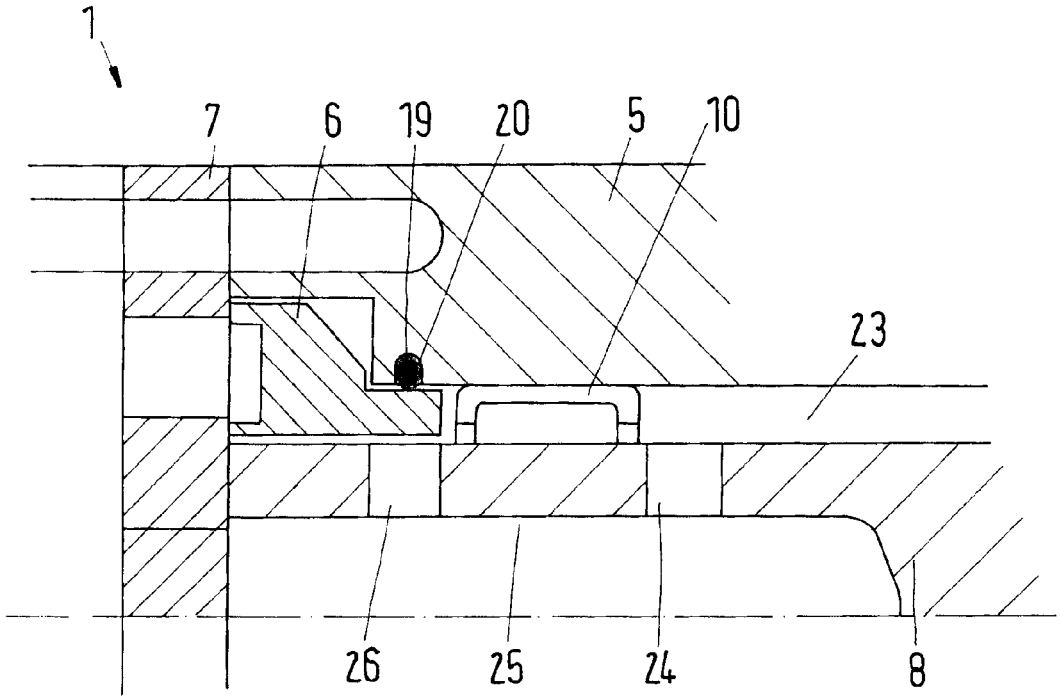

FIG. 5 shows a further embodiment of the hydraulic machine 1, in which the annular sealing 19 is not, as in the previous examples, arranged axially but radially between the rotary slide valve 6 and the housing 5. In this connection, the same elements have the same reference numbers. If required, this embodiment also comprises a spring between the housing 5 or a housing-fixed component and the rotary slide valve 6 to press the rotary slide valve reliably against the valve plate 7 also when the working pressure of the working medium is low. The annular sealing is arranged in the groove 20 with a clearance, so that an axial movement of the annular sealing is possible. The sealing occurs via the radial inside and outside of the annular sealing 19.

While the present invention has been illustrated and described with respect to a particular embodiment thereof, it should be appreciated by those of ordinary skill in the art that various modifications to this invention may be made without departing from the spirit and scope of the present.

What is claimed is:

1. A hydraulic machine comprising a housing section with a housing, a commutation section and a gear wheel section, the gear wheel section comprising a gear wheel set with an internally toothed gear ring and an externally toothed gear wheel, which engage each other and form working chambers that are connected to at least one inlet connection and at least one outlet connection via the commutation section that comprises a rotary slide valve and a valve plate, wherein a sealing is arranged between the rotary slide valve and the housing in an annular groove, the position of the sealing in the radial direction being clearance-subjected, the sealing being radially displaceable inside the groove.

2. The hydraulic machine according to claim 1, wherein the sealing is axially prestressed.

3. The hydraulic machine according to claim 1, wherein the sealing has two areas, a housing-side area being made to be elastic and an area facing the valve plate comprising a friction-reducing material.

4. The hydraulic machine according to claim 1, wherein the sealing is unrotatably held in the housing.

5. The hydraulic machine according to claim 1, wherein the rotary slide valve is unrotatably held on a drive shaft.

6. The hydraulic machine according to claim 1, wherein in the groove the sealing separates an area that is connected to the inlet connection from an area that is connected to the outlet connection.

7. The hydraulic machine according to claim 1, wherein the drive shaft has a channel, a working medium being transportable to the rotary slide valve through the channel.

8. The hydraulic machine according to claim 7, wherein the channel connects an outer annular chamber that is formed between the housing and the drive shaft to an inner annular chamber that is formed between the drive shaft and an articulated shaft.

* * * * *